US005422065A

United States Patent [19]

Hauner et al.

[11] Patent Number: 5,422,065

[45] Date of Patent: Jun. 6, 1995

[54] SILVER-BASED CONTACT MATERIAL FOR USE IN POWER-ENGINEERING SWITCHGEAR, AND A METHOD OF MANUFACTURING CONTACTS MADE OF THIS MATERIAL

[75] Inventors: Franz Hauner, Röttenbach; Wolfgang Haufe, Hessdorf, both of Germany

[73] Assignee: Siemens Aktiengesellschaft, Munich, Germany

[21] Appl. No.: 142,354

[22] PCT Filed: May 13, 1992

[86] PCT No.: PCT/DE92/00384

§ 371 Date: Nov. 23, 1993

§ 102(e) Date: Nov. 23, 1993

[87] PCT Pub. No.: WO92/22079

PCT Pub. Date: Dec. 10, 1992

[30] Foreign Application Priority Data

May 27, 1991 [DE] Germany ..... 41 17 312.0

[51] Int. Cl.[6] ..... C22C 1/00; H01B 13/00

[52] U.S. Cl. ..... 420/501; 148/430; 148/678; 420/505

[58] Field of Search ..... 420/501, 505; 148/430, 148/678

[56] References Cited

U.S. PATENT DOCUMENTS

| | | | |
|---|---|---|---|
| 2,365,249 | 12/1944 | Compstock | 148/430 |
| 3,310,718 | 3/1967 | Lupfer | 317/258 |
| 3,511,953 | 5/1970 | Schmidt, Jr. | 200/166 |
| 4,081,644 | 3/1978 | Davies | 148/430 |
| 4,859,238 | 8/1989 | Weise et al. | 75/233 |
| 4,911,769 | 3/1990 | Yamada et al. | 148/430 |
| 5,022,932 | 6/1991 | Yamada et al. | 148/430 |

FOREIGN PATENT DOCUMENTS

| | | |
|---|---|---|
| 0338401 | 10/1989 | European Pat. Off. . |
| 747830 | 1/1945 | Germany . |
| 888178 | 8/1953 | Germany . |
| 1086441 | 8/1960 | Germany . |
| 3810218 | 10/1988 | Germany . |
| 3802811 | 8/1989 | Germany . |
| WO89/10417 | 11/1989 | WIPO . |

OTHER PUBLICATIONS

Schreiner et al., "The Properties of P/M Electrical Contact Materials", *The International Journal of Powder Metallurgy & Powder Technology,* vol. 12, No. 3, Jul. 1976, pp. 219–228.

Horst Schreiner, "Pulvermetallurgie elektrischer Kontakte", Springer–Verlag, Berlin/Göttingen/ Heidelberg (1964), pp. 100–109–164–167.

Technische Rundschau Informations Palette.

*Primary Examiner*—Upendra Roy

*Attorney, Agent, or Firm*—Kenyon & Kenyon

[57] ABSTRACT

The contact material in particular for contacts in low-voltage switches consists of silver and further active components. In accordance with the invention, iron (Fe) in proportions of between 1 and 50% by weight and rhenium (Re) in proportions of between 0.01 and 5% by weight are present in combination as active components. The manufacture of the material and the fabricating of the contacts can be effected by methods of powder metallurgy with inclusion of molding or extrusion techniques, the active components being used in the form of separate powders, as fusible alloy or as mechanically alloyed powder.

17 Claims, No Drawings

SILVER-BASED CONTACT MATERIAL FOR USE IN POWER-ENGINEERING SWITCHGEAR, AND A METHOD OF MANUFACTURING CONTACTS MADE OF THIS MATERIAL

FIELD OF THE INVENTION

The present invention relates to a contact material having a base of silver for use in power-engineering switchgear, particularly for contacts in low-voltage switches, which, in addition to silver, contains as a further active component at least one higher melting metal, a metal alloy or a metal compound. In addition, the invention also refers to a method for the manufacture of contacts from such material.

BACKGROUND OF THE INVENTION

For contacts in power-engineering switchgear, for instance in power switches as well as in direct current, motor and auxiliary contactors, contact materials of the silver/metal (AgMe) system have proven suitable for a long time. Representatives of this system are, for instance, silver-nickel (AgNi) and silver-iron (Ag—Fe).

Silver-nickel has advantageous contact properties which, together with the test methods for contact materials are described for instance in INT.J Powder Metallurgy and Powder Technology, Vol 12 (1976), pp. 219–228. There is the disadvantage, however, that nickel dust, in particular, has injurious effects on the human organism.

The use of iron in silver-based contact materials has been proposed on various occasions. It has, however, been found that silver-iron does not yet satisfy the requirements stipulated, since, upon the continuous passage of current through such contacts, excessive heating takes place which can be explained by the formation in this system of a cover layer, thus increasing the contact resistance. Furthermore, from Federal Republic of Germany OS 3 813 311 (WO-A-89/10417) a sintered contact material of the aforementioned type is known which, in addition to silver as active component, contains at least iron and/or titanium. Particularly when the iron and the titanium are present in alloyed form and form an intermetallic compound, good results were obtained in switching tests. Nitrides, carbides and/or borides of metals, in particular of titanium, can possibly be present as further active components.

Furthermore, in DE-C-38 16 895 the use of a silver-iron material having 3 to 30 wt.% iron and one or more of the additions manganese, copper, zinc, antimony, bismuth oxide, molybdenum oxide, tungsten oxide and chromium nitride in amounts of a total of 0.05 to 5 wt.%, balance silver, is proposed for electric contacts. Finally, from DE-A-39 11 904 a method of powder metallurgy is known for the manufacture of a semifinished product for electric contacts from a composite material having a base of silver with iron in which 5 to 50 wt.% iron is used as first secondary component and 0 to 5 wt.% of a second secondary component from one or more substances from the group which contains the metals titanium, zirconium, niobium, tantalum, molybdenum, manganese, copper and zinc as well as their oxides and carbides.

SUMMARY OF THE INVENTION

Starting from the above prior art, the object of the invention is to provide a further silver-based contact material and the corresponding method of manufacture.

The new material is characterized by low contact heating with stable heating behavior, reasonable tendency towards welding together, and a long life with respect to predetermined switch current intensities.

This object is achieved, in accordance with the invention, with a material of the aforementioned type in the manner that iron in proportions of between 1 and 50% by weight and rhenium in proportions of between 0.01 and 5% by weight are present as active components in combination. For the fabricating of contacts from the material of the invention, the iron and the rhenium can be added to the silver in the form of pure metals and/or as alloy, the material being manufactured by powder metallurgy. The ratio of the proportions by weight of iron to rhenium can be between 4:1 and about 20:1.

DETAILED DESCRIPTION OF THE INVENTION

Within the scope of the present invention, it has been recognized that, in particular, rhenium in combination with iron and silver improves the spectrum of properties as contact material. The use of rhenium in combination with silver was to be sure already proposed in the specialized literature. In it, to be sure, the rhenium was provided as sole component in a comparatively high proportion, for instance 20% by weight. In view of its high price, such a material has not been able to gain acceptance. Within the scope of the present invention, it has now been recognized that, even as minor component, rhenium improves a silver-iron material in the desired manner.

In a preferred further development of the invention, the iron content is considerably less than 50%. In particular, in the case of such a material, the iron is present in proportions of 2 to 25% by weight and the rhenium in proportions of 0.1 to 3 by weight. Particularly advantageous results have been obtained in switch tests with contact materials in which the iron is present in proportions by weight of 2 to 10% and the rhenium in proportions by weight of 0.1 to 1%. The total proportion by volume of the two active components can vary in this connection within comparatively wide limits. For instance, it is 6, 12 or 18%.

Further details and advantages of the invention will be evident from the following description of embodiments, read in conjunction with the further dependent claims. In this connection, there are first of all discussed different methods for the manufacture of the material claimed and on the other hand the accompanying table containing individual examples of concrete compositions of material in accordance with the invention.

The table contains measured values for the excess temperature of the materials claims, which were measured in each case on the contact bridge of the switchgear. In the first column of the measured temperature values there is set forth the maximum excess temperature ($T\ddot{U}_{max}$) and in the second column the average bridge temperature ($T\ddot{U}$), which result in each case as difference in temperature from room temperature. The measured temperature values were obtained in experiments with a 15 KW contactor up to a number of switchings of $n_s$=50,000 switchings.

The table covers six embodiments with pertinent compositions of the silver-iron-rhenium contact material claimed. In this connection, the manufacture of the actual material and the fabricating of the corresponding contacts is effected by, in part, different methods. The measured values of the individual AgFeRe materials are compared with AgFe9 as well as AgRe20 and with pure silver. The results will be discussed in detail further below.

First Method of Manufacture

For the manufacture of a contact material Ag(-FeRe20)5,7 an iron-rhenium alloy consisting of 80 parts of iron and 20 parts of rhenium is first of all produced by melting. This molten alloy is atomized by known methods in molten state so that in each case a composite FeRe powder is present. A particle size of about 25 μm of the powder is screened off.

To the alloy powder there is then added by weighing a corresponding amount of commercial powdered silver, so that a material having proportions by weight of 5, 7 iron-rhenium, balance silver is obtained. After wet mixing for a suitable period of time, moldings from the powder mixture are compressed with a pressure of about 200 MPa to form contacts. For a dependable technique of connecting the contact to the contact holder by brazing it may be advantageous in this compressing process to press a second layer of pure silver together with the actual contact layer so as to form a two-layer contact.

This is followed by sintering the moldings at a temperature of about 850° C. for about one hour in a vacuum or under inert gas. In order to obtain the lowest possible porosity on the part of the final contact, the sintered bodies are then further compressed under a pressure of about 1000 MPa and again sintered for about one hour in vacuum or under inert gas at about 650° C. The calibrating of the contacts produced in this manner is again effected under a pressure of about 1000 MPa.

With an identical manner of procedure, the proportions of silver and FeRe alloy can be varied. A material with 9.9 parts by weight of FeRe20, balance silver, was in particular examined.

Second Method of Manufacture

In another method, separate powders of iron, rhenium and silver are used as starting material. By wet mixing of the individual powders, a powder mixture is prepared. Strips or wires of the material are first of all produced as semifinished product from the powder mixture by the so-called extrusion technique. The process conditions with respect to temperature on the one hand and pressure on the other hand lie, in this connection, within the known order of magnitude. Contacts with directional structure can then be cut from the semifinished product this produced.

By the powder-metallurgical method for the manufacture of the addition components, three materials were prepared in which the ratio of iron to rhenium was about 4:1 or 9:1. The total proportion of the addition components was selected optionally as 5.3 m %, 5.7 m % and 9.4 m %. Another material was prepared with a ratio of iron to rhenium of 19:1 and a total proportion of addition components of 8.8 m %.

It is also possible to combine the different methods indicated as examples for the production of the addition components on the one hand and the production of the contact on the other hand, in some other manner with each other. In particular, the manufacture of the alloys or of the powder mixtures can be effected by so-called mechanical alloying of single-component individual powders. In this way, the structural properties of the final material are advantageously influenced.

The table shows that in the case of all five examples of the material of the invention in accordance with different methods or of the contacts fabricated therefrom there are sufficient numbers of switchings, amounting in each case to more than 50,000. Such numbers of switchings cannot be obtained with silver-rhenium or pure silver.

In addition to the pure number of switchings, the excess temperature in the switchgear is controlling for the use of the switch material. The excess temperature can be measured at different points of the switchgear and is determined directly on the bridge in the present examinations. To this extent, the comparative examples should be noted.

As is to be expected, pure silver or silver-rhenium 20 have a favorable excess-temperature behavior with, to be sure, low numbers of switchings. As compared with this, AgFe9 has such a high excess temperature as no longer to be acceptable in practice. The high excess temperature can be explained by the formation of a cover layer which increases the contact resistance and thus leads to increased heating on the contact.

As compared with this, all examples of the material of the invention show that the excess temperature is decreased. To be sure, the values of pure silver or silver-rhenium are not reached, but there are reached orders of magnitude which permit use of the material in switchgear. In this connection, it must be borne in mind that in the first column the maximum excess-temperature values of the contact bridge are indicated. If one furthermore takes into account the mean bridge temperatures set forth in the last column, one arrives there at extremely favorable values.

The comparison of the material with the prior art shows that the combination of silver with iron and rhenium produces a material of low contact heating and of stable heating behavior and long life with respect to the switch current values. In this way, a substantial advance is obtained over the prior art.

TABLE

| Material | Manufacture Addition Component | Manufacture Contact | Number of Switchings | $T_{U(max)}$ in K | Mean Bridge Temperature in K |
|---|---|---|---|---|---|
| AgFe9 | | SP | >50,000 | 145 | 67 |
| Ag(FeRe20)5,7 | SM | FT | >50,000 | 113 | 57 |
| Ag(FeRe20)9,9 | SM | FT | >50,000 | 107 | 67 |
| Ag(FeRe80/20)5,7 | PM | SP | >50,000 | 100 | 59 |
| Ag(FeRe90/10)5,3 | PM | SP | >50,000 | 93 | 61 |
| Ag(FeRe90/10)9,4 | PM | SP | >50,000 | 111 | 65 |
| Ag(FeRe95/5)8,8 | PM | SP | >50,000 | 106 | 72 |
| AgRe20 | | SP | 16,000 | 73 | — |

TABLE-continued

| Material | Manufacture Addition Component | Manufacture Contact | Number of Switchings | $T_{U(max)}$ in K | Mean Bridge Temperature in K |
|---|---|---|---|---|---|
| Ag | | | 22,600 | 74 | — |

SM: Fusion metallurgy
PM: Powder metallurgy
FT: Molding
SP: Extrusion

We claim:

1. A silver-based contact material for use in power-engineering switchgear, comprising silver and at least one higher melting metal, a metal alloy, or a metal compound, wherein the silver-based contact material contains between 1 and 50% by weight iron (Fe) and between 0.01 and 2% by weight rhenium (Re) as active components.

2. The contact material according to claim 1, wherein the iron (Fe) is present in a proportion of less than 40% by weight.

3. The contact material according to claim 1, wherein the ratio of the proportions by weight of iron (Fe) to rhenium (Re) is between 4:1 and 20:1.

4. The contact material according to claim 1, wherein the volumetric proportion of the active components together is about 6%.

5. The contact material according to claim 1, wherein the volumetric proportion of the two active components is together about 12%.

6. The contact material according to claim 1, wherein the volumetric proportion of the two active components together is about 18%.

7. The contact material according to claim 1, wherein the iron (Fe) is present in a proportion of 2 to 25% by weight.

8. The contact material according to claim 2, wherein the iron (Fe) is present in a proportion of less than 30% by weight.

9. The contact material according to claim 7, wherein the iron (Fe) is present in a proportion of 2 to 20% by weight and the rhenium (Re) is present in a proportion of 0.1 to 2% by weight.

10. The contact material according to claim 9, wherein the iron (Fe) is present in a proportion of 2 to 10% by weight and the rhenium (Re) is present in a proportion of 0.1 to 1.0% by weight.

11. A method of manufacturing a contact from a silver-based contact material by powder metallurgy, comprising the steps of: preparing an alloy from iron and rhenium, atomizing the alloy to form an alloy powder, and fabricating a contact from a material which includes the alloy powder and silver powder, wherein the material contains between 1 and 50% by weight iron and between 0.01 and 2% by weight rhenium.

12. The method according to claim 11, wherein the FeRe alloy is prepared by melting down in a vacuum or under inert gas.

13. The method according to claim 11, wherein the FeRe alloy is prepared by mechanical alloying in a vacuum or under inert gas.

14. The method according to claim 11, wherein the fabrication of the contact is effected by molding.

15. The method according to claim 11, wherein the manufacture of the contact is effected by extrusion, wherein an extruded semifinished contact product is produced from the powders and the contact is cut from the extruded product.

16. A method of manufacturing a contact by powder metallurgy, comprising the steps of preparing separate powders of silver, iron and rhenium, and fabricating a contact from a material which includes each of said powders, wherein the material includes between 1 and 50% by weight iron and between 0.01 and 2% by weight rhenium.

17. A method of manufacturing a contact by powder metallurgy, comprising the steps of preparing separate powders of silver, iron and rhenium, mechanically alloying said powders of silver, iron and rhenium to form an alloy, and fabricating a contact from said alloy, wherein said alloy contains between 1 and 50% by weight iron and between 0.01 and 2% by weight rhenium.

* * * * *